United States Patent [19]

Krob et al.

[11] 4,210,342

[45] Jul. 1, 1980

[54] CONNECTING ELEMENT

[75] Inventors: Erwin Krob, Vienna; Erwin Weigl, Brunn am Gebirge, both of Austria

[73] Assignee: TMC Corporation, Baar, Switzerland

[21] Appl. No.: 836,844

[22] Filed: Sep. 26, 1977

[30] Foreign Application Priority Data

Sep. 24, 1976 [AT] Austria ..... 7121/76

[51] Int. Cl.[2] ..... A63C 11/00

[52] U.S. Cl. ..... 280/636; 280/605

[58] Field of Search ..... 280/636, 633, 623, 611, 280/607, 605; 403/393, 353

[56] References Cited

U.S. PATENT DOCUMENTS

| | | | |
|---|---|---|---|
| 3,540,749 | 11/1970 | Marker | 280/636 |
| 3,992,030 | 11/1976 | Salomon | 280/633 |
| 4,022,493 | 5/1977 | Weigl et al. | 280/633 |

FOREIGN PATENT DOCUMENTS

| | | | |
|---|---|---|---|
| 1910060 | 9/1970 | Fed. Rep. of Germany | 280/636 |
| 2429639 | 3/1975 | Fed. Rep. of Germany | 280/605 |
| 212811 | 3/1941 | Switzerland | 280/636 |

*Primary Examiner*—David M. Mitchell

*Attorney, Agent, or Firm*—Blanchard, Flynn, Thiel, Boutell & Tanis

[57] ABSTRACT

A connecting element for connecting a stepping plate to a ski binding. In this disclosure, a pair of such stepping plates are provided, one of which has a ski brake mounted thereon, the other of which has no ski brake associated therewith. In certain areas, ski brakes are not desirable and the skier will use safety straps for securing the ski to the leg of the skier. Thus, to enable the skier to select the mode of equipment which will meet the local conditions, a stepping plate and ski binding combination is provided which permits a selective coupling of the desired stepping plate. The connecting element consists of suspended and receiving parts, one of the parts having hooks thereon co-operably coupled with receiving structure on the other part. Other structure is provided to give the connection lateral rigidity.

6 Claims, 9 Drawing Figures

CONNECTING ELEMENT

FIELD OF THE INVENTION

The invention relates to a connecting element for selectively securing two stepping plates to a ski binding mounted on a ski and serve in the clamped-in position of the ski boot in the ski binding as a base support for said ski boot with one of the stepping plates supporting a ski brake, wherein preferably each stepping plate can be moved by means of a guide plate on a ski-fixed guide rail and can be fixed in different positions viewed in longitudinal direction of the ski, wherein furthermore between stepping plate and guide plate there is provided a resilient pull rod.

BACKGROUND OF THE INVENTION

A stepping plate which is arranged in the heel area of the ski binding and is held on the ski lying below the sole of the ski boot is known in various embodiments. It is also known to connect the stepping plate to the ski binding through a resilient pull rod, which construction is built particularly in order to be able to maintain constant, during adjustment of the ski binding in longitudinal direction of the ski, the distance between the ski binding part and the stepping plate. The resilient construction assures as elasticity in the case of a bending of the ski.

It is, on the other hand, known to mount ski brakes on the ski in different mountings. However, this measure has the disadvantage that the cross section of the ski is weakened by providing additional screw holes. Therefore, the desire exists to mount the ski brake on a part which already exists on the ski. For this purpose, the stepping plate is provided. The constant presence of a ski brake can possibly also be disadvantageous, for example if the skier—for whatever reasons—does not need some or cannot use same. Also a prohibition of the use of ski brakes in certain ski areas can force the skier to use a common safety device in the form of a safety strap. In such a case, it is in turn necessary to remove the stepping plate carrying a ski brake and to provide a common stepping plate for the ski binding.

The purpose of the invention is now to overcome this problem and to provide a simple connecting element which is suited both for securing a common stepping plate and also a stepping plate which is equipped with a ski brake, wherein the connection must be strong during use and its parts must be able to be produced at a small expense and must be able to be easily handled.

The set purpose is inventively attained by the pull rod being constructed in two parts consisting of suspended and receiving parts, wherein preferably the part which is associated with the stepping plate is constructed as a suspended part and the part which is associated with the guide plate as a receiving part, and by the suspended part being able to be hooked by means of hooks, noses or the like to receiving points of the receiving part, furthermore by providing between the two engaging hooks, noses or the like on the one side and receiving points on the other side at least one pair of laterally arranged support surfaces.

Through the described construction of the connecting element all goals are achieved. The parts can be manufactured with little expense and the connecting element is just as suited for receiving of pull forces occurring in longitudinal direction as for receiving of laterally acting components and the two parts can easily be joined together and separated from one another.

A particularly preferable embodiment of the invention is characterized by providing at the free end of the suspended part two barbs, wherein both the receiving point of the barbs and also they themselves lie each along a line of curvature, the radii centerpoints of which, referred to the connecting point, lie on the side which is opposite the stepping plate, and by the receiving part having a recess, into which a tongue of the suspended part, which tongue is bent up preferably from its own material, can be inserted preferably with clearance. This embodiment provides a particularly strong connection, because engagement of the associated parts along the lines of curvature is suited without deformation for receiving of great pull forces.

A further embodiment of the invention consists in providing two pairs of lateral support surfaces, which, viewed in longitudinal direction of the ski, are arranged one behind the other in pairs. In this manner a particularly strong arrangement against lateral swing is produced.

A further part of the invention consists in the receiving part having in each area, in which the suspended part engages, a reinforcement for example in form of a rib and/or of extensions. As a result, the formation of lines of curvature can be avoided, without creating the unwanted danger of a deformation.

According to a further embodiment, the invention consists in both the suspended part and also the receiving part having noses which are bent at the end areas, which noses can be inserted into corresponding receiving points of the other part, wherein the nose of the receiving part is reinforced outwardly at the free end viewed perpendicularly with respect to the longitudinal direction of the ski and is received in a recess, the cross section of which tapers down in longitudinal direction of the ski and away from the slide plate, in addition the receiving point of the receiving part is constructed as a slide surface in the area, in which during the introduction the nose of the suspended part is added. In this manner, a kind of a duplicate coupling is provided between the two parts.

BRIEF DESCRIPTION OF THE DRAWINGS

Further details and advantages of the invention will now be discussed more in detail with reference to the drawings, which show several exemplary embodiments.

In the drawings:

FIGS. 1 to 4 illustrate a first exemplary embodiment, wherein FIGS. 1 and 2 are associated views with FIG. 1 being a side elevational view, FIG. 2 being a top view and FIGS. 3 and 4 being each side elevational views similar to FIG. 1, and wherein in FIGS. 1 and 2 the stepping plate does not have a ski brake and in FIGS. 3 and 4 the stepping plate has a ski brake and is mounted on the ski binding, in addition that FIGS. 1 and 3 each illustrate a position in which the stepping plate is not coupled and in FIGS. 2 and 4 the coupled position is shown;

FIGS. 5 and 6 are associated views of a second exemplary embodiment omitting further details which relate to the invention, wherein FIG. 5 illustrates a separated relationship and FIG. 6 illustrates a coupled relationship; and FIGS. 7 and 8 illustrate a further exemplary embodiment similar to FIGS. 5 or 6.

DETAILED DESCRIPTION

Figure 1:
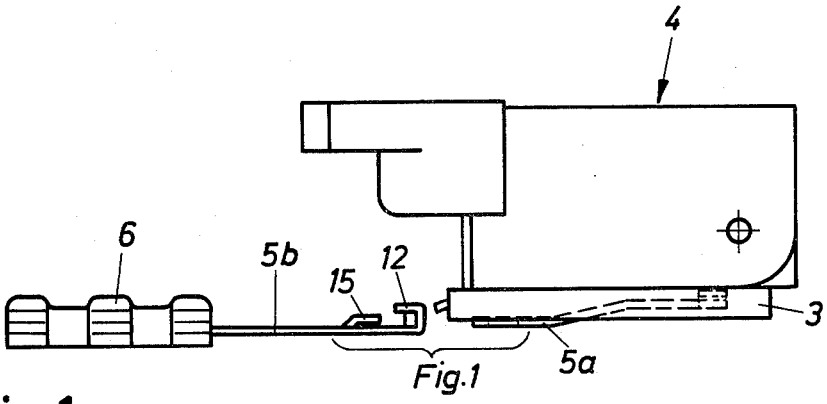
Figure 1A:
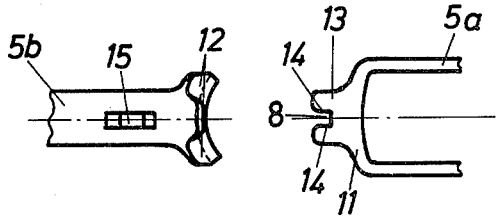
FIG. 1*a* is a top view of the inventive connection of FIG. 1.

The following description describes component parts which do not constitute the actual subject matter of the invention only to the extent the discussion is necessary to understand the subject matter of the invention. Corresponding parts in the several embodiments are indicated with one and the same reference numeral, parts which fulfill similar purposes have a prime (') suffix for the purpose of differentiating.

As will be recognized from the first exemplary embodiment according to FIGS. 1 to 4, a ski 1 is provided and on the upper side 1*a* thereof a guide rail 2 is secured, for example by threaded fasteners (screws are not separately illustrated) for supporting a guide plate 3 of a ski binding 4. For a better understanding, FIG. 2 does not show the ski binding 4, so that a view into the structure of the guide plate 3 is made possible.

Figure 2:
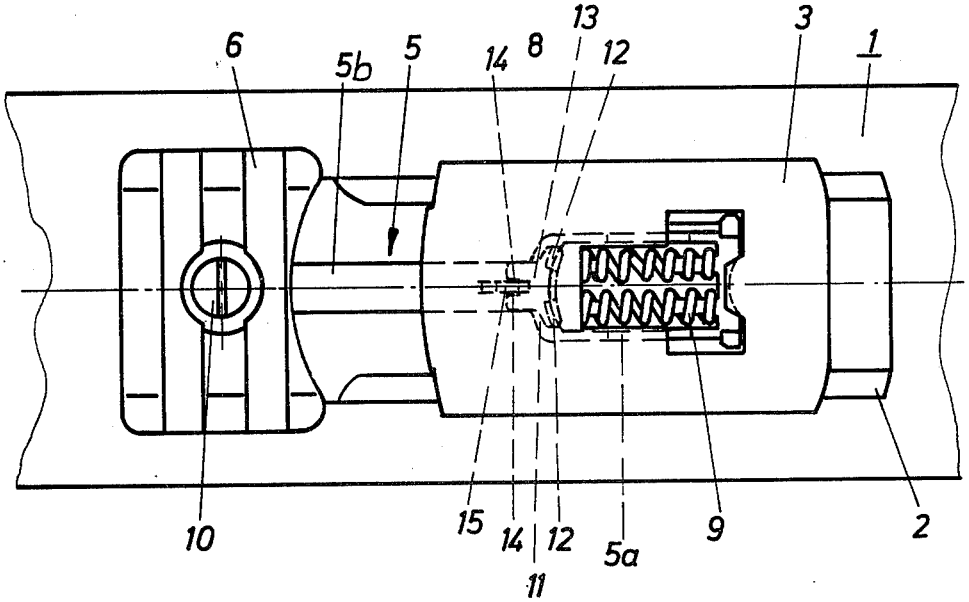
Figure 3:
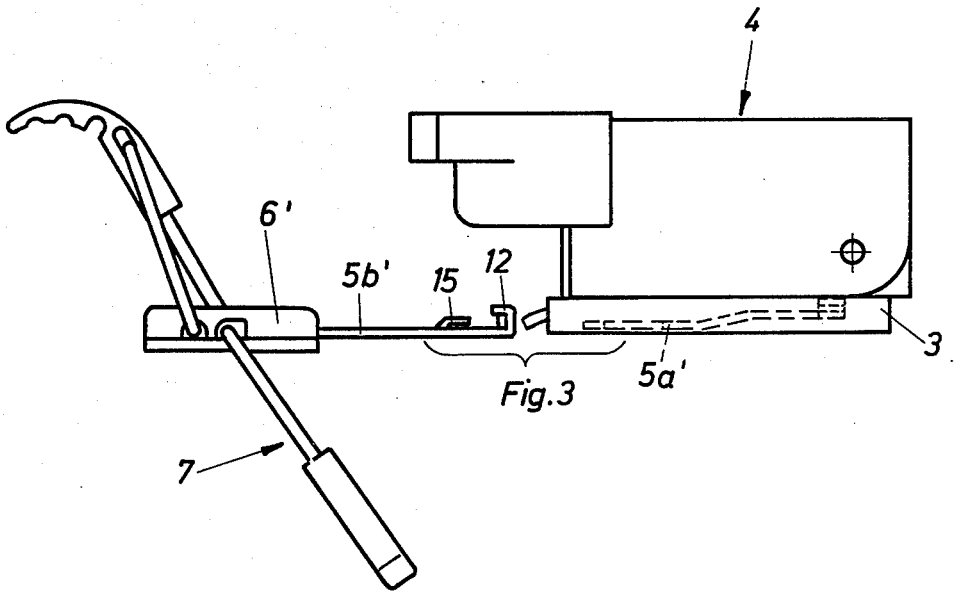
Figure 4:
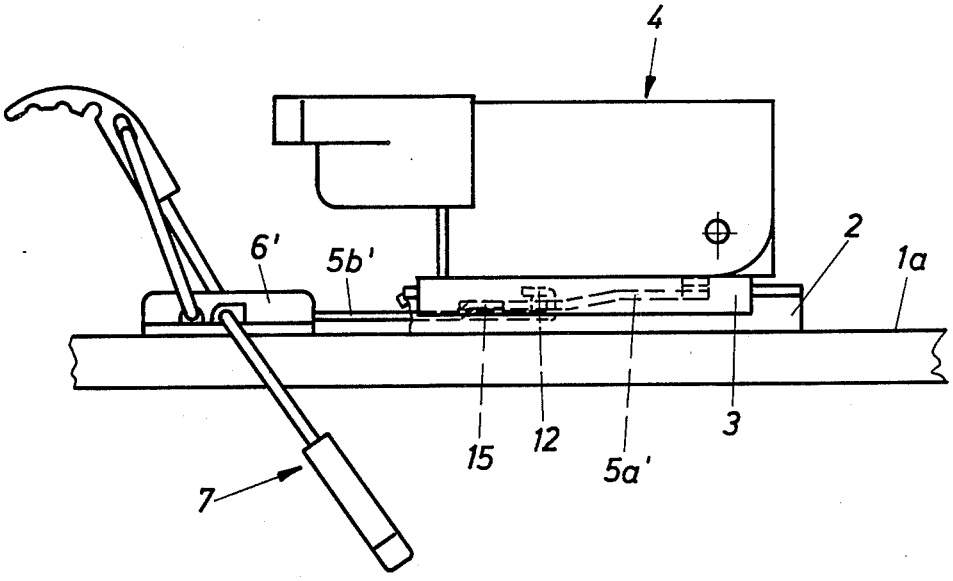

As can be seen from the figures, FIGS. 1 and 2 illustrate a stepping plate 6 without a ski brake and with the ski binding 4 and FIGS. 3 and 4 illustrate a stepping plate 6' with a ski brake 7 and with the ski binding 4. To connect the stepping plate 6, 6' to the ski binding 4, a pull rod which as a whole has the reference numeral 5 is provided and consists of two parts, namely a suspended part 5*b*, which is associated with the stepping plate 6 and a receiving part 5*a*, which is associated with the guide plate 3. The receiving part 5*a* is maintained independent from the design of the stepping plate 6 or 6'. The design of the suspended part 5*b* is also adapted for use with both stepping plates 6, 6'; only for the purpose of a better understanding the suspended part 5*b*' has been identified for the stepping plate 6' and the ski brake 7 with a separated primed reference numeral.

In particular from FIG. 2, the structure of the receiving part 5*a* can also be seen in detail. It will be recognized that the guide plate 3 has a recess for receiving springs 9 therein and on which the rearwardly extending end of the receiving part 5*a* is supported. Such a resilient pull rod is for example known from German Offenlegungsschrift No. 1 578 843, published Mar. 4, 1971. Thus a further description of this part is not needed. It must only be mentioned that the stepping plate 6 can be fixedly located by means of a locking device 10 in the desired position on the guide rail 2, by rotating the head of the locking device 90° by means of a coin or by means of a screw driver or the like. The release in turn is accomplished by a rotation through 90°. This type of fastening is described in German OS No. 1 910 060 Published Sept. 10, 1970 and does not need to be discussed any further.

The connecting element which concerns more in detail the subject matter of the invention will be described in detail with reference to the structure of the pull rod 5. The receiving part 5*a* has a receiving end 11 with the suspended part 5*b* or 5*b*' having hooks 12 secured to the receiving end. FIGS. 1 and 3 show the suspended part 5*b* or 5*b*' with the stepping plate 6 or 6' fixedly mounted thereon in a not mounted or disconnected condition. This illustrated position can therefore be both the position after a release of the two parts (4 and 6 or 4 and 6') or a position prior to a coupling therebetween. Both procedures take place in a position free from engagement with the ski and, as a result, the ski is not shown. For the man skilled in the art it will be obvious that for hooking the hooks 12 onto the receiving point 11 the two parts must be guided toward one another at an angle to one another. Also the release of the connection therebetween is done in a similar manner. The coupled position is illustrated in FIG. 2, however, FIG. 4 also shows the coupled position.

The hooking of the hooks 12 onto the receiving point 11 alone would not offer a defined position of the stepping plate 6 or 6' with respect to a lateral stress. Resistance to lateral forces or for receiving the same lateral support surfaces 14 of a recess 8 are provided on the receiving part 5*a*, namely on a front end of the receiving part 5*a* and is designed as an extension 13 and lies in direction of the stepping plate 6, 6'. The support surfaces 14 are engaged by a nose 15 on the suspended part 5*b* according to FIG. 2 or can be engaged according to FIGS. 1 or 3. The nose 15 is punched, in the present exemplary embodiment, from the material of the suspended part 5*b* or 5*b*' and the material strength of the receiving part 5*a* is correspondingly increased. The arrangement is such that between the receiving part 5*a* and the suspended part 5*b* viewed in longitudinal direction of the ski there is created a clearance-free coupling, so that the two parts act as one single pull rod 5. It is unimportant whether or not the brake-free stepping plate 6 or the stepping plate 6' which is provided with the brake 7 is associated with its suspended part 5*b* or 5*b*' and the receiving part 5*a*.

It will be recognized without any further discussions, that for installing or removing the structure requires no special precautionary measures to be taken. It is sufficient to release the locking device 10, to move the ski binding 4 with the existing stepping plate 6 or 6' from the guide rail 2, to release the existing coupling of the suspended part 5*b* or 5*b*', to bring into engagement the other stepping plate 6' or 6 with the suspended part 5*b*' or 5*b* with the receiving part 5*a* and to move the thus mounted unit again onto the guide rail 2, then to again fix the locking device 10. The design is such that both the stepping plate 6 alone and also the stepping plate 6' with the ski brake 7 are not released from the receiving part 5*a* during the mounting procedure, so that the installation itself can be carried out easily even by unexperienced skiers in connection with an easily understood instruction.

Figure 5:
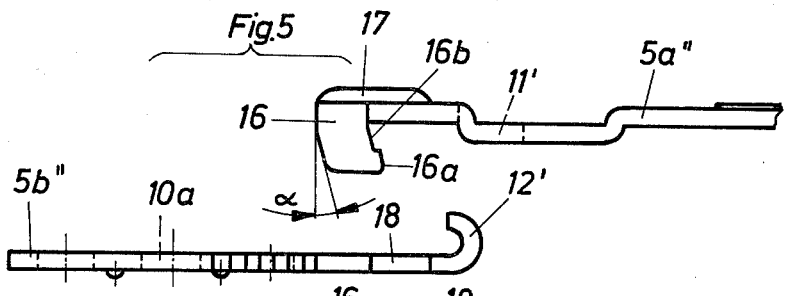
Figure 6:
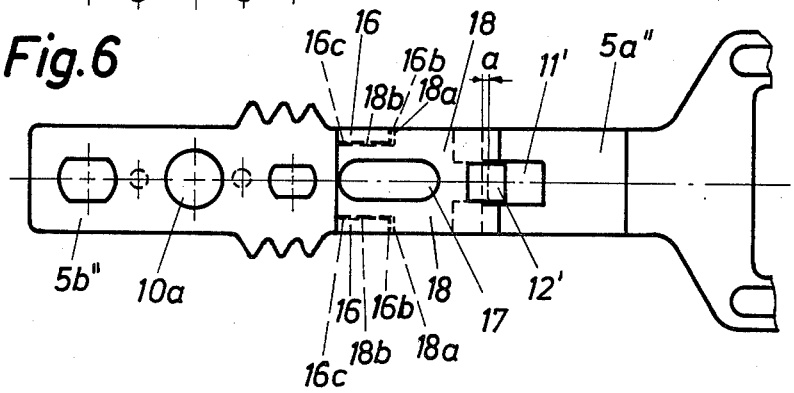

In the second embodiment according to FIGS. 5 and 6, the connecting element has a receiving part 5*a*'' and a suspended part 5*b*''. The ski binding and stepping plate have been omitted from the illustration so that the entire structure of the pull rod can be recognized. The receiving part 5*a*'' has at its free end which faces the suspended part 5*b*'' laterally downwardly bent flanges 16 which extend slightly inclined to the vertical rearwardly and have at their free ends reinforcing extensions 16*a*. A further reinforcing element in the form of a rib 17 is mounted on the upper side of the receiving part 5*a*'. The rib 17 can either be made by bending the material of the receiving part 5*a*'' or be made of a separate material and can be put on the receiving part 5*a*'' for example by welding. The reinforcing extensions 16*a* of the two flanges 16 serve not only the purpose of reinforcement, they additionally prevent an unintentional release after the two parts 5*a*'' and 5*b*'' have been hooked together. For this purpose, the suspended part 5*b*'' has a hook 12' thereon which engages a receiving point 11'' which is a rectangular opening in the material of the receiving part 5*a*''. The receiving part 5*a*'' moreover has a bent area 11' in this area so that after engagement of the suspended part 5*b*'' with the receiving part 5a'', the undersides of these two parts will lie as much as possible in one common plane. There is a need to keep the structural height of the entire device as low as possible. For engagement of the two flanges 16 with the suspended part 5b'' the suspended part 5b has on both sides outwardly extending wings 18, the lateral support surfaces 18a are used for engaging or supporting the inner support surfaces 16b of the two flanges 16. In this position, the pull forces are absorbed by the two support surfaces 18a and 16b; a lateral centering occurs through the support of the side surfaces 16c on the outer side surfaces 18b of the wings 18 on the one side and through the support of the hook 12' on the two inner sides of the receiving point 11'. It must further be mentioned that between the free end of the hook 12' and the front end of the receiving point 11' there exists a free space a. This free space is important in order to associate the receiving of the pull forces only with the flanges 16 and the wings 18. As can be taken from this description, two pair of associated support surfaces are provided for the lateral guideway and are arranged in pairs one behind the other viewed in longitudinal direction of the ski. To be complete FIG. 5 also specifies the off-set angle $\alpha$ for the slope of the flanges 16.

The assembly or release of the two parts 5a'', 5b'' occurs in a similar manner as already described above, namely during assembly first the hook 12' must be introduced into the receiving point 11' and then engagement of the flanges 16 with the wings 18 must take place, compared with which during the disassembly a reversed sequence must be maintained. Ski binding and stepping plate are attached and secured in the manner which has already been described in connection with FIGS. 1 to 4; it is only mentioned here that for receiving the not illustrated locking device 10, an opening 10a in the suspended part 5b'' is used. The further parts do not form a subject matter of the present invention and can be taken from the already mentioned German Offenlegungsschrift No. 1 910 060.

Figure 7:
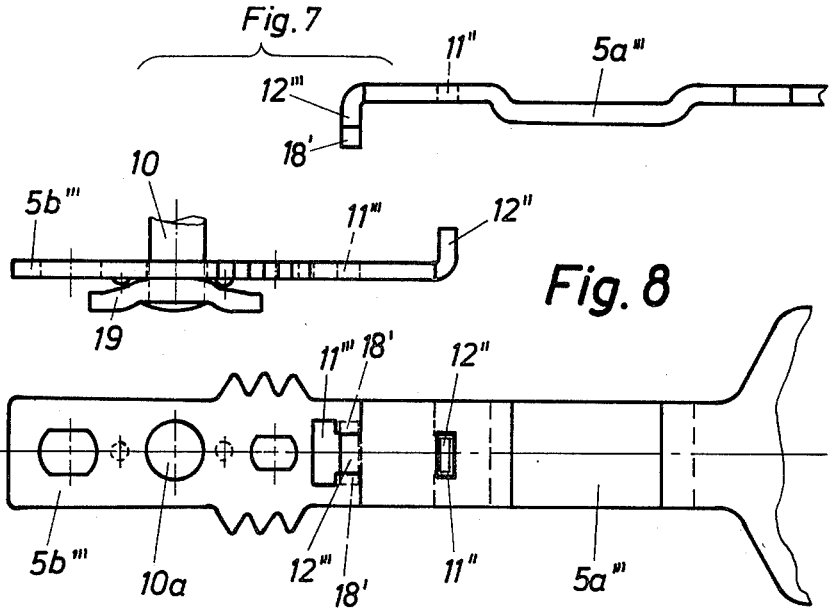

In the next exemplary embodiment according to FIGS. 7 and 8, again a receiving part 5a''' and a suspended part 5b''' can be recognized. In this embodiment at the free ends of both parts there can be recognized bent hooks 12'' and 12''' which are positioned substantially perpendicularly with respect to the connecting plane of the two parts. The hook 12'' of the connecting part 5b''' engages a receiving point 11'' which is constructed in the material of the receiving part 5a''' as an opening, which receiving part 11'' receives the hook 12'' practically without clearance. The hook 12''' of the receiving part 5a''' engages in turn a receiving point 11''' of the connecting part 5b'''.

As can particularly be recognized from FIG. 8, the receiving point 11''' is formed in the form of an approximately T-like recess, wherein the stem of the T has only a length which corresponds to the material thickness of the engaging hook 12'''. It can furthermore be recognized that the hook 12''' has a form which corresponds substantially to the receiving point 11''' with the difference that the hook lies in a plane which extends perpendicularly with respect to the receiving point 11'''. Thus the lateral wings 18' constitute in the hung-in condition of the two parts 5a''' and 5b''' a safe and only voluntarily releasable connection. This is accomplished by first inserting during assembly the hook 12''' into the receiving point 11''', then pulling the receiving part 5a''' and the suspended part 5b'' against one another in longitudinal direction so that the hook 12'' is introduced into the receiving point 11''. If this condition is reached, then a duplicate lock is created, in which the pull forces are transmitted from the two hooks 12'' and 12''' in the associated receiving points 11'' or 11''' from receiving part 5a''' to suspended part 5b''' and vice versa and the not especially identified side surfaces of the already mentioned hooks with the also not separately identified side surfaces of the associated receiving points also assure the provision of the necessary lateral guide. Also in this case the already bent area is recognizable; after assembly only the free end of the hook 12''' extends below the common plane of the undersides of the two parts; the extension is here, however, of no disadvantage worth mentioning, because the area which extends freely downwardly is in alignment with the hook and associated with the lower end of the lock. For this reason, FIG. 7 also indicates the lock 19. The area of the hook 12'' which after assembly extends upwardly lies below the plane in which an operation during stepping into the ski binding occurs. The produced connection is practically a clearance-free connection.

During assembly of this embodiment, the hook 12''' of the receiving part 5a''' must be first introduced into the associated receiving point 11''' and after pulling apart the two parts, the hook 12'' must engage the receiving point 11''. During release of the connection, the reversed operation must be performed. Securing the attaching or releasing and removing of the ski binding and stepping plate (possibly with brake) takes place in the already described manner.

The invention is not limited to the illustrated exemplary embodiments. Further variations can take place without departing from the scope of the invention. With respect to the use of the described embodiments, one will use the one which appears to be most advantageous for the connection with the existing ski binding. The first exemplary embodiment permits according to FIGS. 1 to 4 the installation of a deep-going mandrel; in the two other exemplary embodiments either a higher end mandrel must be used or same must be provided with a corresponding recess.

A further modification can consist in the flanges which exist on the receiving part and which are bent downwardly not having a slope at their edges which face the suspended part, but a rounded-off part, preferably in the form of an arc. It is also conceivable that the slope or rounded-off part exists only in the lower area and extends upwardly in vertical alignment. In the case of an arc preferably a tangential course between the rounded-off part and the vertical plane is chosen. In any case, a simple introduction of the flange is supposed to be assured.

It is also conceivable to use the inventive connecting element for securing a stepping plate on a ski binding which is not secured through a holding rail on the ski. For example, the ski binding can be secured directly on the upper side of the ski. To set up the necessary height for the pull rod, corresponding base supports can be used.

The illustrated exemplary embodiments have shown the ski binding as a heel holder. It is easily conceivable to use the connecting element for holding a stepping or slide plate on a front jaw. One of the exchangeable stepping and slide plates can then receive a corresponding ski brake.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a connecting element for the selective fastening of a stepping plate to a guide plate on a guide rail secured to a ski, said stepping plate and said guide plate being spaced from each other along the longitudinal axis of said ski, said stepping plate functioning as a base support for a ski boot when said ski boot is operatively associated with a ski binding mounted on said guide plate, wherein guide means are provided for guiding and supporting said guide plate for movement in a direction parallel to said longitudinal axis of said ski to selected positions, the improvement comprising wherein said connecting element comprises an elongated pull rod connected to and extending between said stepping plate and said guide plate and having first and second parts and releasable connecting means for connecting said first and second parts together, said first part being connected to said stepping plate and said second part being connected to said guide plate, said releasable connecting means including first projection means on one of said first and second parts, first receiving means on the other of said first and second parts for releasably receiving said first projection means therein, said releasable connecting means further including lateral support means for providing lateral stability to said stepping plate, said lateral support means comprising second projection means on one of said first and second parts and second receiving means on the other of said first and second parts for releasably receiving said second projection means therein, said first projection means and cooperating first receiving means, when said first and second parts are connected together, being spaced longitudinally along the length of the connected first and second parts from said second projection means and cooperating second receiving means to minimize relative lateral movement between said first and second parts and for maintaining the longitudinal axis of said pull rod parallel to said longitudinal axis of said ski.

2. The improved connecting element according to claim 1, wherein said first receiving means includes a recess, wherein said first projecting means comprises two laterally spaced hooks each having a receiving part, wherein both of said receiving parts of said hooks extend coextensively with a line of curvature, said recess having a surface received in said receiving parts of said hooks, said surface extending in a curve whose centerpoint is the same as the centerpoint of said line of curvature, and wherein said second receiving means includes notch means on one of said first and second parts and said second projection means includes a tongue member on the other of said first and second parts releasably received in said notch means, said tongue and notch being spaced along the longitudinal axis of said pull rod from said hooks.

3. The improved connecting element according to claim 1, wherein said second projection means includes a pair of laterally spaced downwardly bent flanges which face inwardly toward the lateral facing edges of said second receiving means of said first part, said flanges having inclined edge surfaces thereon extending inclined toward said guide plate and have reinforcing extensions at the free ends of said flanges.

4. The improved connecting element according to claim 3, wherein said first part has a pair of laterally extending wings adjacent said second receiving means, wherein said second part has a rib intermediate said pairs of flanges for reinforcing sad second projection means, wherein said pair of flanges each have inner support surfaces which are supported in a locking condition on outer side surfaces of said wings on said first part.

5. The improved connecting element according to claim 4, wherein said two wings form with their outwardly projecting support surfaces receiving points for said inner support surfaces on said flanges.

6. The improved connecting element according to claim 1, wherein said releasable first and second projection means both comprise hooks on the free end of each of said first part and said second part and wherein said first and second receiving means both comprise a recess spaced intermediate said hook and said stepping plate and said guide plate for receiving a hook therein, said hook of said second projection means and said recess of said second receiving means associated therewith having a substantially rectangular cross-sectional shape and an approximately T-shaped design having laterally spaced wings, wherein said two hooks extend in a plane which is perpendicular with respect to the plane of said first and sacond parts, and wherein said laterally spaced wings of said T-shaped hook form in engaged condition a connection which can only voluntarily be released.

* * * * *